US006164366A

United States Patent [19]

Fish et al.

[11] Patent Number: 6,164,366

[45] **Date of Patent: *Dec. 26, 2000**

[54] STRIP CASTING APPARATUS

[75] Inventors: John Andrew Fish, Woonona, Australia; Heiji Kato, Yokosuka, Japan

[73] Assignees: Ishikawajima-Harima Heavy Industries Company Ltd., Tokyo, Japan; BHP Steel (JLA) Pty Ltd, Melbourne, Australia

[ * ] Notice: This patent is subject to a terminal disclaimer.

[21] Appl. No.: 09/154,209

[22] Filed: Sep. 16, 1998

[30] Foreign Application Priority Data

May 28, 1997 [AU] Australia ..... PP3752
Sep. 18, 1997 [AU] Australia ..... PO9253

[51] Int. Cl.[7] ..... B22D 11/06

[52] U.S. Cl. ..... 164/480; 164/428; 72/239

[58] Field of Search ..... 164/428, 480; 72/239, 244, 246, 446, 448

[56] References Cited

U.S. PATENT DOCUMENTS 5,706,882 1/1998 Fellus et al. ..... 164/154.5

FOREIGN PATENT DOCUMENTS 60-145253 7/1985 Japan ..... 164/480
62-6740 1/1987 Japan ..... 164/480
1380816 3/1988 Russian Federation ..... 72/244

*Primary Examiner*—Kuang Y. Lin
*Attorney, Agent, or Firm*—Miles & Stockbridge P.C.; John C. Kerins

[57] ABSTRACT

Apparatus for continuously casting metal strip comprises a pair of parallel casting rolls (16). In use of the apparatus molten metal is delivered between the casting rolls which are rotated to deliver cast strip product downwardly from the rolls. Casting rolls (16) are mounted on a roll module (13) installed in and removable from the caster as a unit. Module (13) is movable horizontally from a stand-by position to an intermediate position beneath a casting position of the rolls and can be hoisted from the intermediate position by operation of hoists (71) to lift the rolls (16) into their casting position.

23 Claims, 8 Drawing Sheets

STRIP CASTING APPARATUS

BACKGROUND OF THE INVENTION

1. Field of the Invention

This invention relates to the casting of metal strip. It has particular application to the casting of metal strip by continuous casting in a twin roll caster.

2. Description of Related Art

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

The change-over of the casting rolls in a twin roll caster is a significant problem. The rolls may need to be changed between casts so as to allow a different width of strip to be cast and the rolls must be replaced if the casting surfaces are in any way damaged or deteriorate during casting. If the rolls have to be changed in situ, a significant amount of potential casting time is lost waiting for the casting components and the area surrounding them to cool. The new set of rolls, once in place, has to be calibrated prior to casting so that the nip width can be pre-set.

When casting ferrous metals, it is necessary to preheat the refractory components of the metal delivery and pool confinement means to very high temperatures before casting commences. For these reasons it has been proposed to build twin roll casters with demountable components so that the rolls and preheated refractory components can be rapidly brought together into an operative assembly and casting started before the preheated components cool significantly. One example of a caster with moveable rolls and refractory components is disclosed in our Australian Patents 631728 and 637548 and corresponding U.S. Pat. Nos. 5,184,668 and 5,277,243.

The present invention enables a twin roll strip caster to be built with a modular construction in which the casting rolls are installed in a moveable module readily moveable into and out of the machine. A previous proposal for mounting the rolls on a moveable module is described in Japanese Patent Publication JP-B93-9185 of Mitsubishi Heavy Industries Ltd. In that proposal the rolls and the pool confining side plates are mounted together on a frame which is carried on a wheeled car moveable horizontally into and out of the machine along rails. The present invention provides a different arrangement in which a roll module is moved horizontally into an intermediate position beneath the final casting position and is then lifted into the casting position. This enables the rolls to be quickly manoeuvred into the casting position without requiring movement of any ancillary equipment or components. In a preferred embodiment of the invention the rolls can be lifted into position between a pair of pool confinement side plates without the need to move the side plates.

SUMMARY OF THE INVENTION

According to the present invention there is provided an apparatus for continuously casting metal strip which includes: a pair of parallel casting rolls forming a nip between them; metal delivery means to deliver molten metal into the nip between the rolls to form a casting pool of molten metal supported on casting roll surfaces immediately above the nip; pool confining means at the ends of the rolls confining the pool against outflow from the ends of the nip; and roll drive means to drive the casting rolls in counter-rotational directions to produce a solidified strip of metal delivered downwardly from the nip; wherein the casting rolls are mounted on a roll module installed in and removable from the caster as a unit and movable horizontally transversely to a casting direction from a stand-by position to an intermediate position beneath a casting position of the rolls and thereafter vertically to lift the rolls to the casting position; and wherein the apparatus includes a lifting means for lifting the roll module and rolls mounted thereon from the intermediate position to the casting position.

Preferably the lifting means includes a fluid cylinder actuated hoist.

Preferably the apparatus includes drive coupling means which automatically couple the roll drive means to the casting rolls when the roll module is in the intermediate position.

Preferably the apparatus includes water coupling means which automatically couple a water cooling means to the rolls when the roll module is in the intermediate position.

Preferably the roll module further includes a module frame and roll carriers moveable on the module frame to permit bodily movement of the rolls toward and away from one another to vary the nip between them.

Preferably the apparatus further includes a roll biasing means operable when the roll module is in the casting position to move the casting rolls from an open position towards each other to vary the width of the nip.

Preferably the pool confining means is in the casting position prior to moving the roll module from stand-by position to the intermediate position and thereafter to the casting position. Moving the roll module to the intermediate position beneath the casting position and holding the casting rolls in the open position ensures that there is no contact between the rolls and the pool confining means during the installation of the rolls.

Preferably the roll biasing means is operable to move the casting rolls away from each other.

Preferably the roll module further includes an adjustable stop means disposed beneath the nip and between the roll carriers to serve as a spacer stop for engagement with the roll carriers to pre-set the minimum width of the nip between the rolls and adjustable in width to vary the minimum width of the nip.

Preferably the roll biasing means is operable to move the casting rolls from an open position to the stop means and thereafter to bias the rolls against the stop means.

Preferably, the roll module further includes a means for holding the roll carriers in the open position.

Preferably the holding means includes a locking pin assembly having locking pins carried by the module frame that can be received in openings in the roll carriers.

Preferably the locking pins are fixed relative to the roll carriers so that when the roll carriers and the rolls thereon are lifted from the intermediate position to the casting position the roll carriers are moved clear of and therefore are not retained by the locking pins.

The roll carriers may comprise a pair of roll end support structures for each of the rolls disposed generally beneath the ends of the respective roll.

Each pair of roll end support structures may carry journal bearings mounting the respective roll ends for rotation about a central roll axis.

The roll end support structures may be mounted on the module frame for generally horizontal movement of the rolls toward and away from one another.

The module frame may be moveable horizontally on linear bearings into and out of the intermediate position in the caster.

The roll module may be firmly clamped vertically by operation of the fluid cylinder actuated hoist described above lifting the roll module so that stop surfaces on the roll module contact fixed stop surfaces on the caster.

Appropriate indexing means may be provided for indexing of the module frame with the main machine frame when the module frame is hoisted so as to provide for accurate positioning of the module frame longitudinally of the rolls.

The roll biasing means may include a pair of biasing units for each roll and the biasing units being connectable to the roll carriers.

The biasing units may be carried on moveable mountings on the caster so that they can be readily moved into and out of operative inter-engagement with the roll carriers.

The invention also provides apparatus for continuously casting metal strip comprising a pair of parallel casting rolls forming a nip between them; metal delivery means to deliver molten metal into the nip between the rolls to form a casting pool of molten metal supported on casting roll surfaces immediately above the nip; pool confining means at the ends of the rolls against outflow from the ends of the nip; and roll drive means to drive the casting rolls in counter-rotational directions to produce a solidified strip of metal delivered downwardly from the nip; wherein the casting rolls are mounted on a roll module installed in and removable from the caster as a unit, said module comprising a module frame; roll carriers moveable on the module frame to permit bodily movement of the rolls toward and away from one another to vary the nip between them; and adjustable stop means disposed beneath the nip and between the roll carriers to serve as a spacer stop for engagement with the roll carriers to pre-set the minimum width of the nip between the rolls and adjustable in width to vary the minimum width of the nip.

According to the present invention there is also provided a method of positioning casting rolls in a continuous strip caster which includes the steps of: moving a roll module carrying a pair of parallel casting rolls horizontally in a direction transverse to a casting direction from a stand-by position to an intermediate position; coupling the rolls to a roll drive means and a water cooling unit at the intermediate position; and lifting the roll module to a casting position.

Preferably, the roll drive means and the water cooling unit are automatically coupled to the rolls when the roll module is moved to the intermediate position.

Preferably, after lifting the roll module to the casting position, the method further includes moving the rolls inwardly to a pre-set nip position.

Preferably, the rolls are held apart prior to being lifted to the casting position and the lifting movement releases the rolls for inward movement.

BRIEF DESCRIPTION OF THE DRAWINGS

In order that the invention may be fully explained one particular embodiment will be described in some detail with reference to the accompanying drawings in which.

DESCRIPTION OF PREFERRED EMBODIMENT

Figure 1:
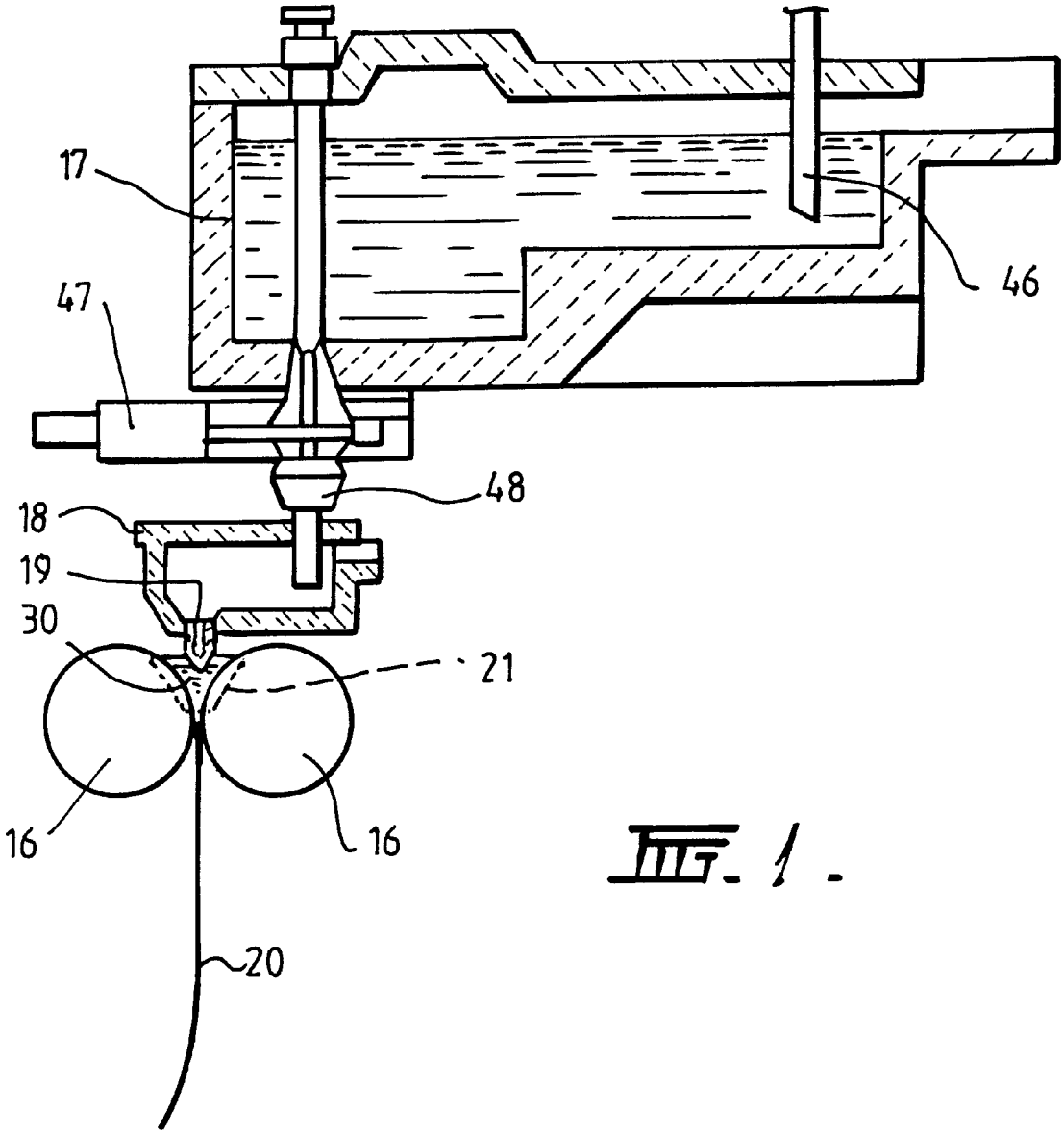
FIG. 1 is a vertical cross section through a strip caster constructed in accordance with the present invention.

The illustrated caster comprises a main machine frame 11 which supports a casting roll module in the form of a roll cassette 13 which can be moved into an operative position in the caster as a unit but can readily be removed when the rolls are to be replaced. Cassette 13 carries a pair of parallel casting rolls 16 to which molten metal is supplied during a casting operation from a ladle (not shown) via a ladle outlet nozzle 46, a tundish 17, a distributor 18 and a delivery nozzle 19 to create a casting pool 30 which is confined by the rolls 16 and by a pair of side closure plates 18. Casting rolls 16 are water cooled so that shells solidify on the moving roll surfaces and are brought together at the nip between them to produce a solidified strip product 20 at the roll outlet. This product may be fed to a standard coiler.

The illustrated twin roll caster as thus far described is of the kind which is illustrated and described in some detail in Australian Patent 664670 and U.S. Pat. No. 5,488,988 which are hereby expressly incorporated by reference, and reference may be made to those patents for appropriate constructional details which form no part of the present invention.

Casting rolls 16 are contra-rotated through drive shafts 41 from an electric motor and transmission which includes drive spindles 128 mounted on the main machine frame. The drive shafts 41 can be disconnected from the transmission when the cassette 13 is to be removed from the caster. Rolls 16 have copper peripheral walls formed with a series of longitudinally extending and circumferentially spaced water cooling passages (not shown) supplied with cooling water through the roll ends from water supply ducts (not shown) in the roll drive shafts 41 which are connected to water supply hoses 42 through rotary glands 43. The rolls may typically be about 500 mm diameter and up to 2000 mm long in order to produce strip product approximately the width of the rolls.

The ladle is of entirely conventional construction and is supported on a rotating turret (not shown) whence it can be brought into position over the tundish 17 to fill the tundish.

The tundish may be fitted with a sliding gate valve 47 actuable by a servo cylinder to allow molten metal to flow from the tundish 17 through the valve 47 and the refractory shroud 48 into the distributor 18.

The distributor 18 is formed as a wide dish made of a refractory material such as magnesium oxide (MgO). One side of the distributor 18 receives molten metal from the tundish 17 and the other side of the distributor 18 is provided with a series of longitudinally spaced metal outlet openings (not shown). The lower part of the distributor 18 carries mounting brackets (not shown) for mounting the distributor onto the main caster frame when the cassette is installed in its casting position.

Delivery nozzle 19 is formed as an elongate body made of a refractory material such as alumina graphite. Its lower part is tapered so as to converge inwardly and downwardly so that it can project into the nip between the casting rolls 16. Its upper part is formed with outwardly projecting side flanges (not shown) which locate on a mounting bracket (not shown) which forms part of the main frame.

Nozzle 19 may have a series of horizontally spaced generally vertically extending flow passages (not shown) to produce a suitably low velocity discharge of metal throughout the width of the rolls 16 and to deliver the molten metal into the nip between the rolls without direct impingement on the roll surfaces at which initial solidification occurs. Alternatively, the nozzle 19 may have a single continuous slot outlet (not shown) to deliver a low velocity curtain of molten metal directly into the nip between the rolls 16 and/or it may be immersed in the molten metal pool.

Side closure plates 18 are made of a strong refractory material, for example boron nitride, and have scalloped side edges to match the curvature of stepped ends of the rolls.

During a casting operation the sliding gate valve 47 is actuated to allow molten metal to pour from the tundish 17 to the distributor 18 and through the metal delivery nozzle 19 whence it flows onto the casting rolls. The head end of the strip product 20 is guided to the jaws of a coiler (not shown).

In accordance with the invention, the roll cassette 13 is movable:

(i) horizontally in a direction that is transverse to the casting direction of the caster (in the casting direction is denoted by the arrow A in the Figures) from a stand-by position located on one side of the caster to an intermediate position beneath a casting position; and thereafter (ii) vertically to the casting position.

Figure 2:
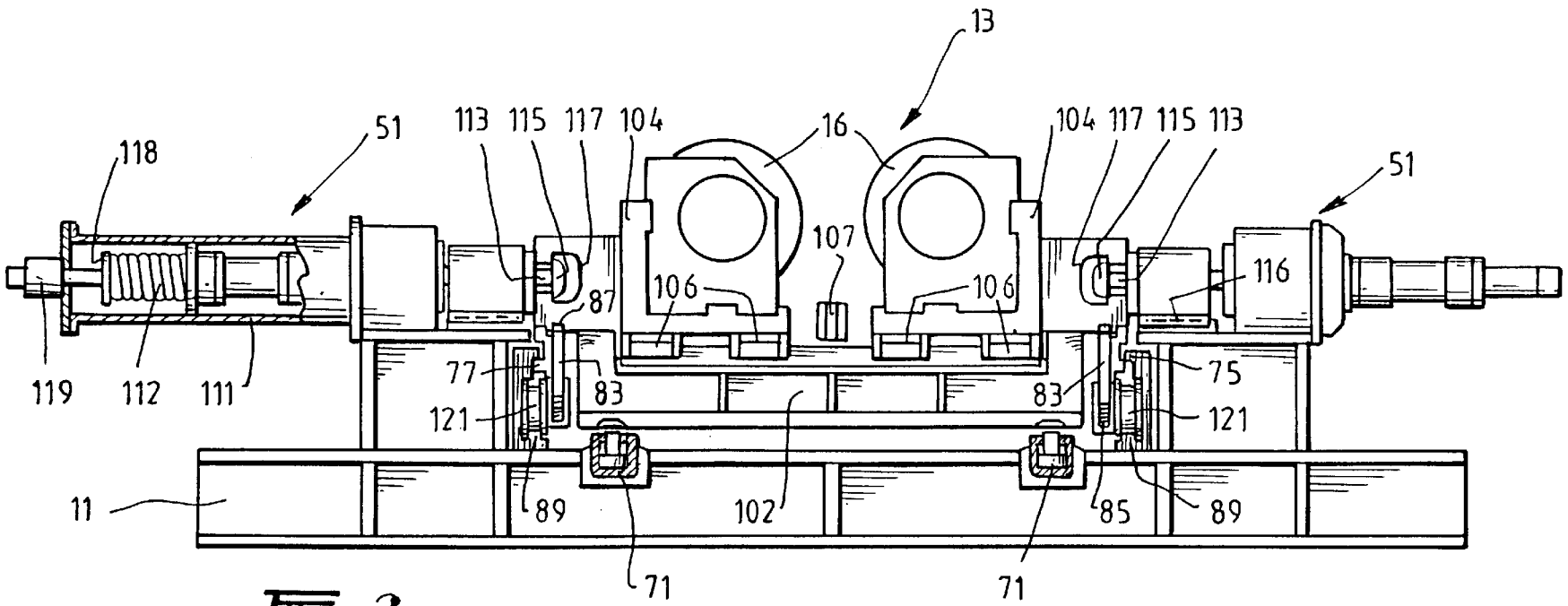
FIG. 2 is a side elevation of the caster shown in FIG. 1 with the tundish and distributor removed for clarity and with the casting roll module in an intermediate position and the casting rolls in an open position.
Figure 4:
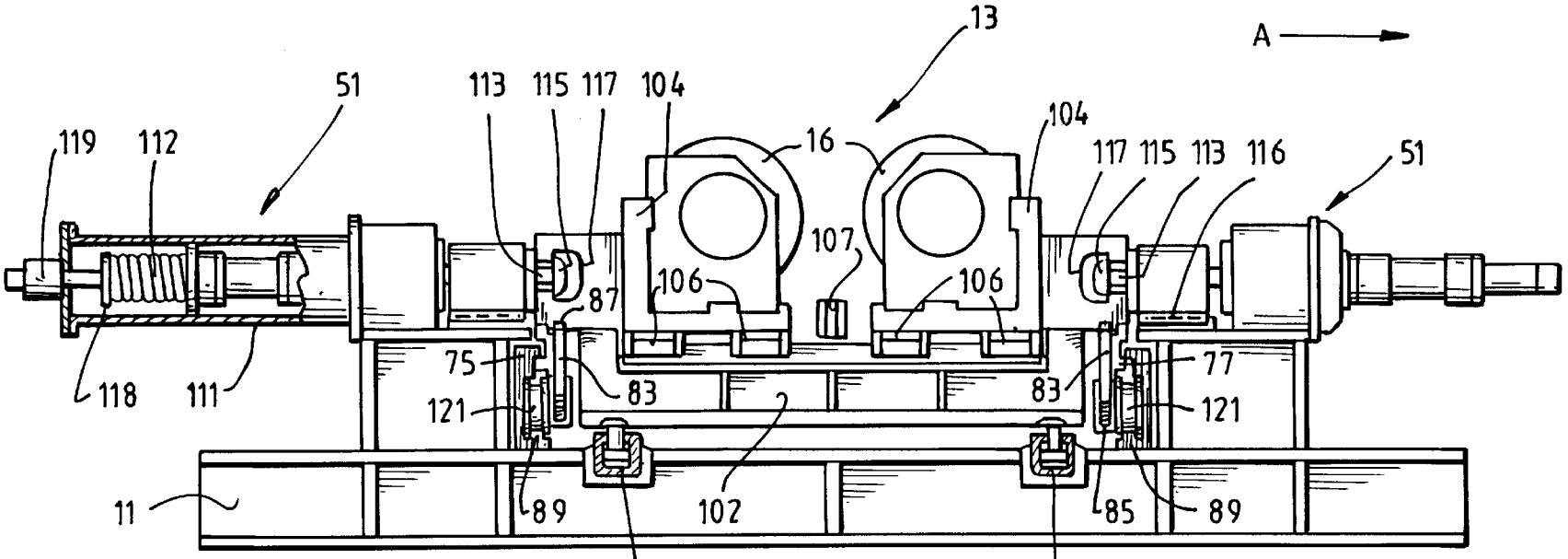
FIG. 4 is a further side elevation of the caster with the roll module in a raised casting position and the rolls in an open position.
Figure 5:
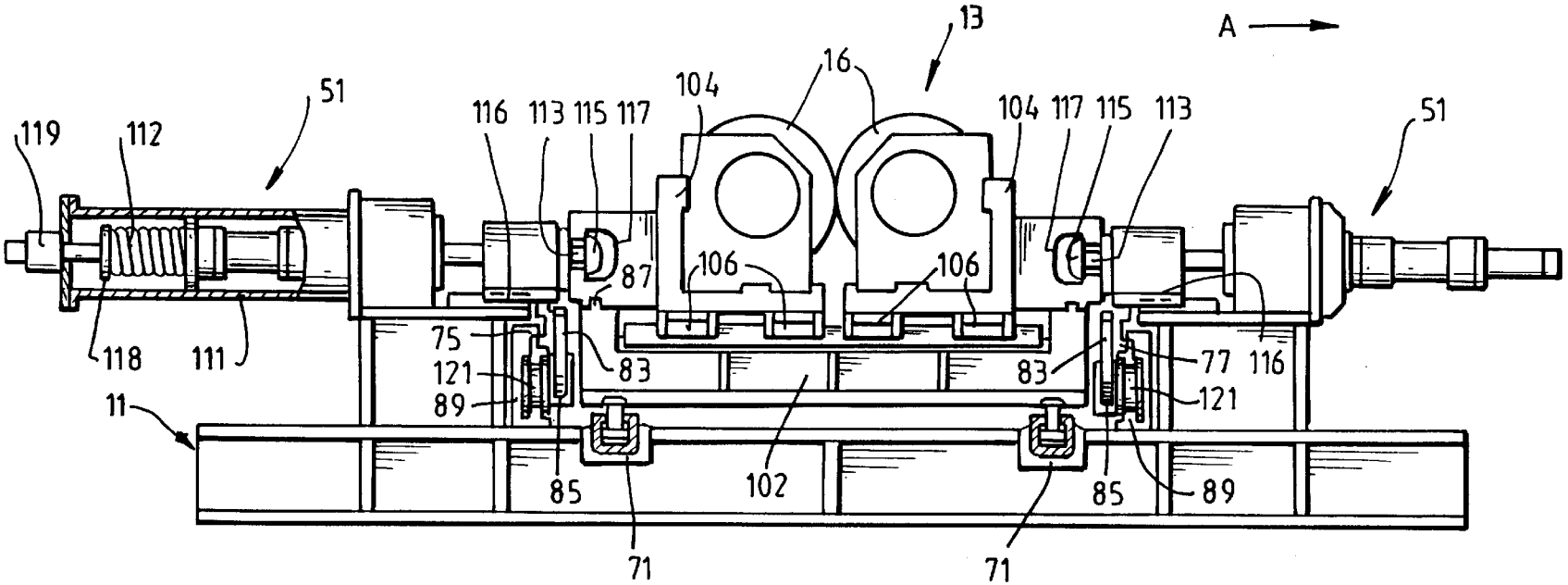
FIG. 5 is a further side elevation of the caster with the roll module in the raised casting position and the rolls at a pre-set nip spacing.
Figure 6:
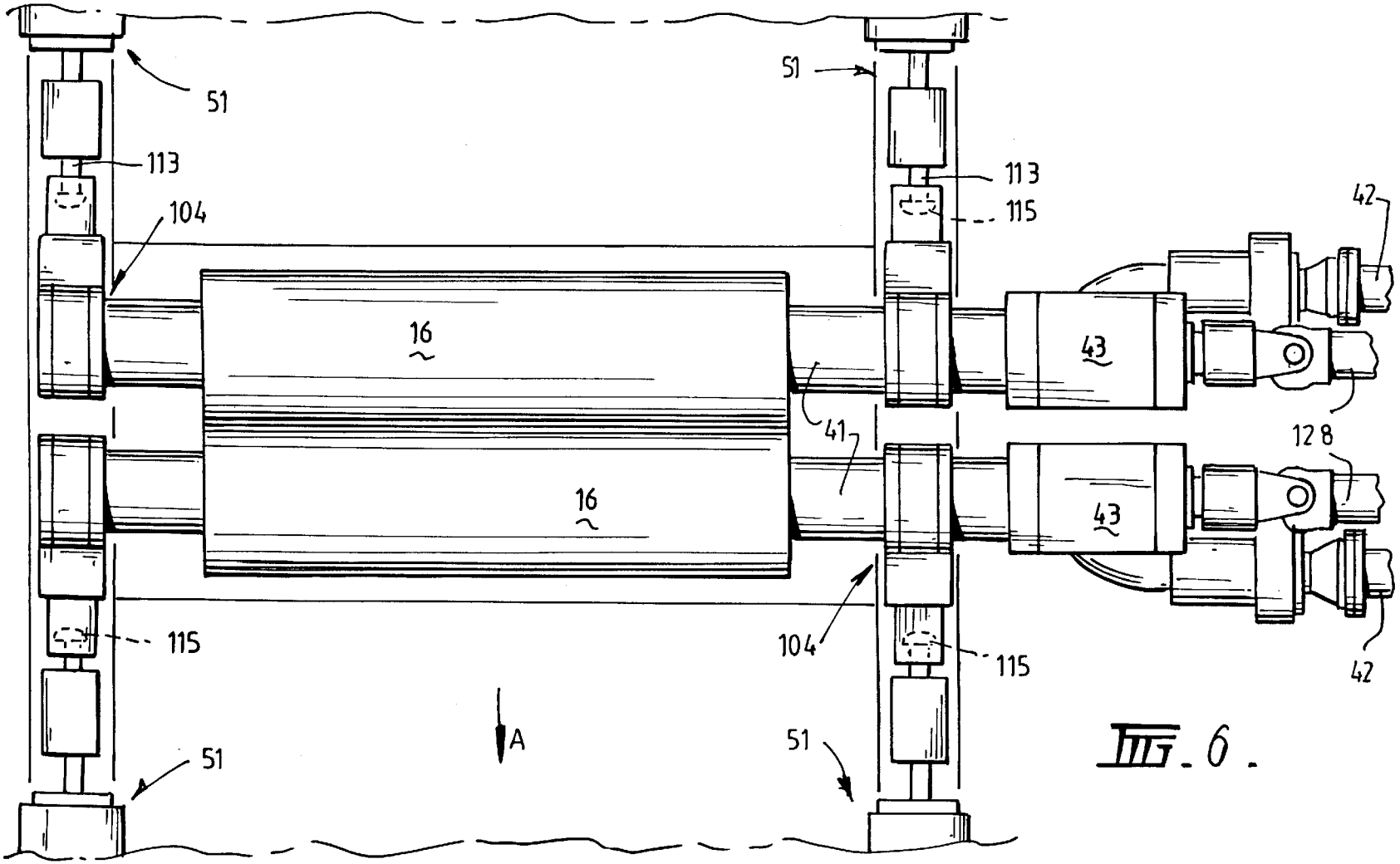
FIG. 6 is a top plan view of the caster.
Figure 7:
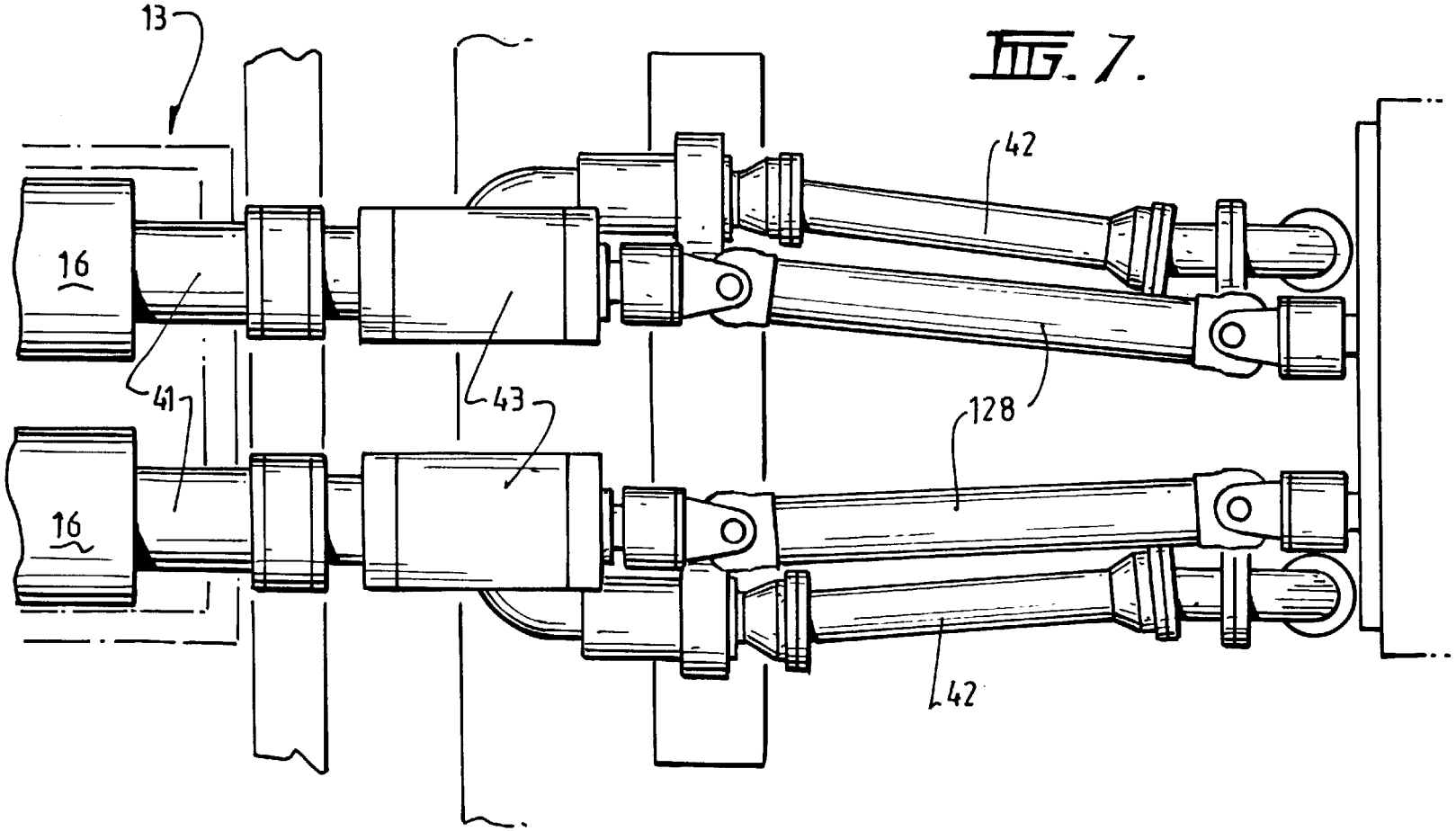
FIG. 7 is a top plan view illustrating in detail an end section of the roll module/casting rolls and the coupling of the rolls to water supply hoses and roll drive spindles.
Figure 8:
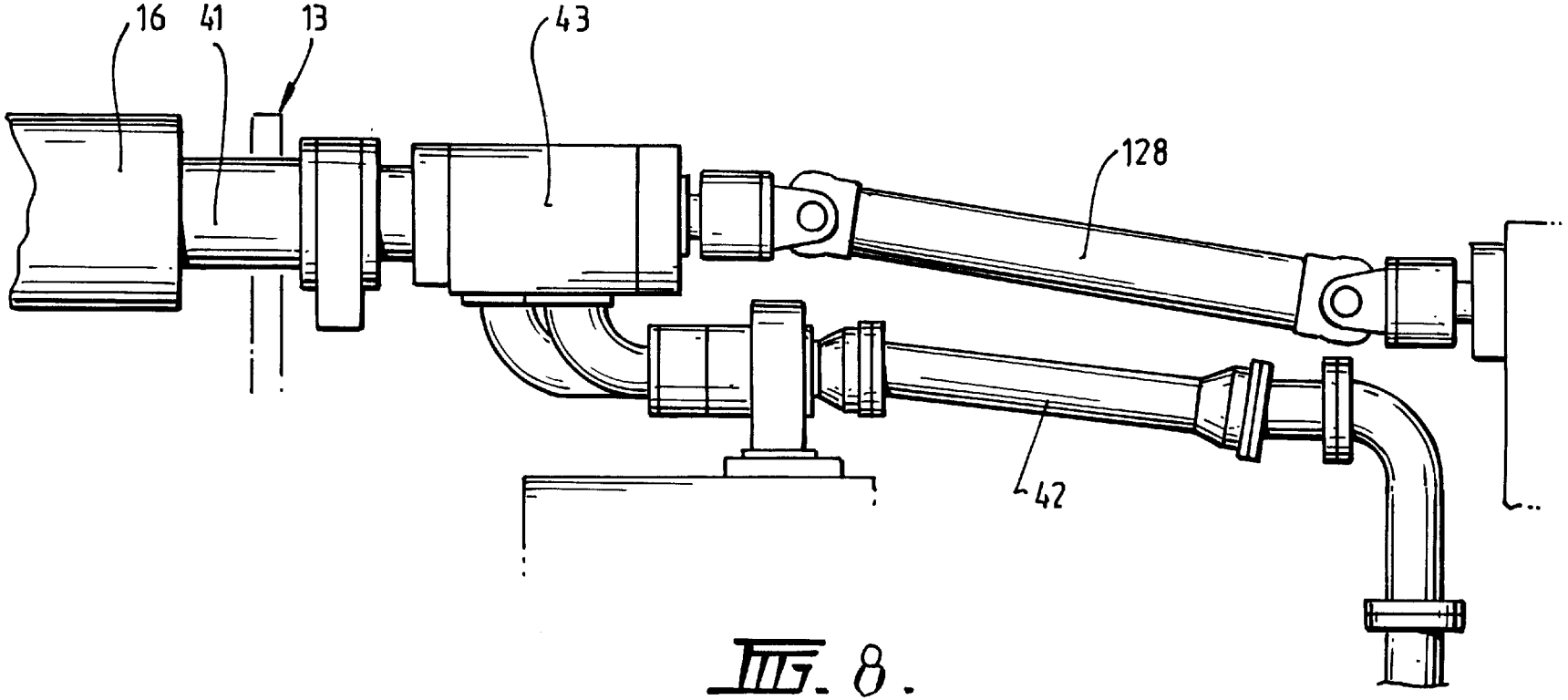
FIG. 8 is a side elevation of the section of the caster shown in FIG. 7.

FIG. 2 shows the roll cassette 13 at the intermediate position and FIGS. 4 and 5 show the roll cassette 13 at the raised casting position.

Movement of the roll cassette 13 to the intermediate position bring the casting rolls 16 into contact with and automatically couples the rolls 16 to the drive spindles 128 and the water supply hoses 42.

The roll cassette 13 is constructed so that the casting rolls 16 can be set up and the nip between them pre-set at the stand-by position before the cassette is installed in position in the caster.

Roll cassette 13 includes a large frame 102 supported on four wheels 121 which carries the rolls 16 and upper part (not shown) of the refractory enclosure for enclosing the cast strip below the nip. The caster includes a pair of rails 89 for guiding the wheels 121 between the stand-by position and the intermediate position. Rolls 16 are mounted on roll supports 104 which carry roll end bearings (not shown) by which the rolls are mounted for rotation about their longitudinal axes in parallel relationship with one another. The two pairs of roll supports 104 are mounted on the roll cassette frame 102 by means of linear bearings 106 whereby they can slide laterally of the cassette frame to provide for bodily movement of the rolls 16 toward and away from one another thus permitting separation and closing movement of the two parallel rolls between an open position shown in FIG. 4 and a pre-set nip position shown in FIG. 5.

The caster includes a lifting means in the form of four fluid cylinder actuated hoists 71 supported by the machine frame 11 and located to underlie the corner regions of the roll cassette frame 102 when the roll cassette 13 is at the intermediate position—as can best be seen in FIGS. 2, 4 and 5. Actuation of the hoists 71 lifts the roll cassette 13 to the casting position. The upward movement of the roll cassette 13 is limited by inwardly extending flanges 75 on the guide rails 89 which are contacted by outwardly extending flanges 77 on the roll cassette frame 102.

The rolls 16 are retained at the open position shown in FIG. 4 by four locking pin assemblies housed in vertical openings in the base of roll cassette frame 102. Each pin assembly includes a locking pin 83 which is biased upwardly by means of a spring 85. In the open position of the rolls 16 shown in FIG. 4 the locking pins 83 extend into openings 87 in the base of roll supports 104. Upward movement of the roll cassette frame 102 relative to the locking pins 83 moves the roll cassette frame 102 clear of the pins and thereby releases the rolls 16 for movement inwardly by the action of roll biasing units 51 described hereinafter to bring the rolls 16 to the pre-set nip position shown in FIG. 5.

Figure 3:
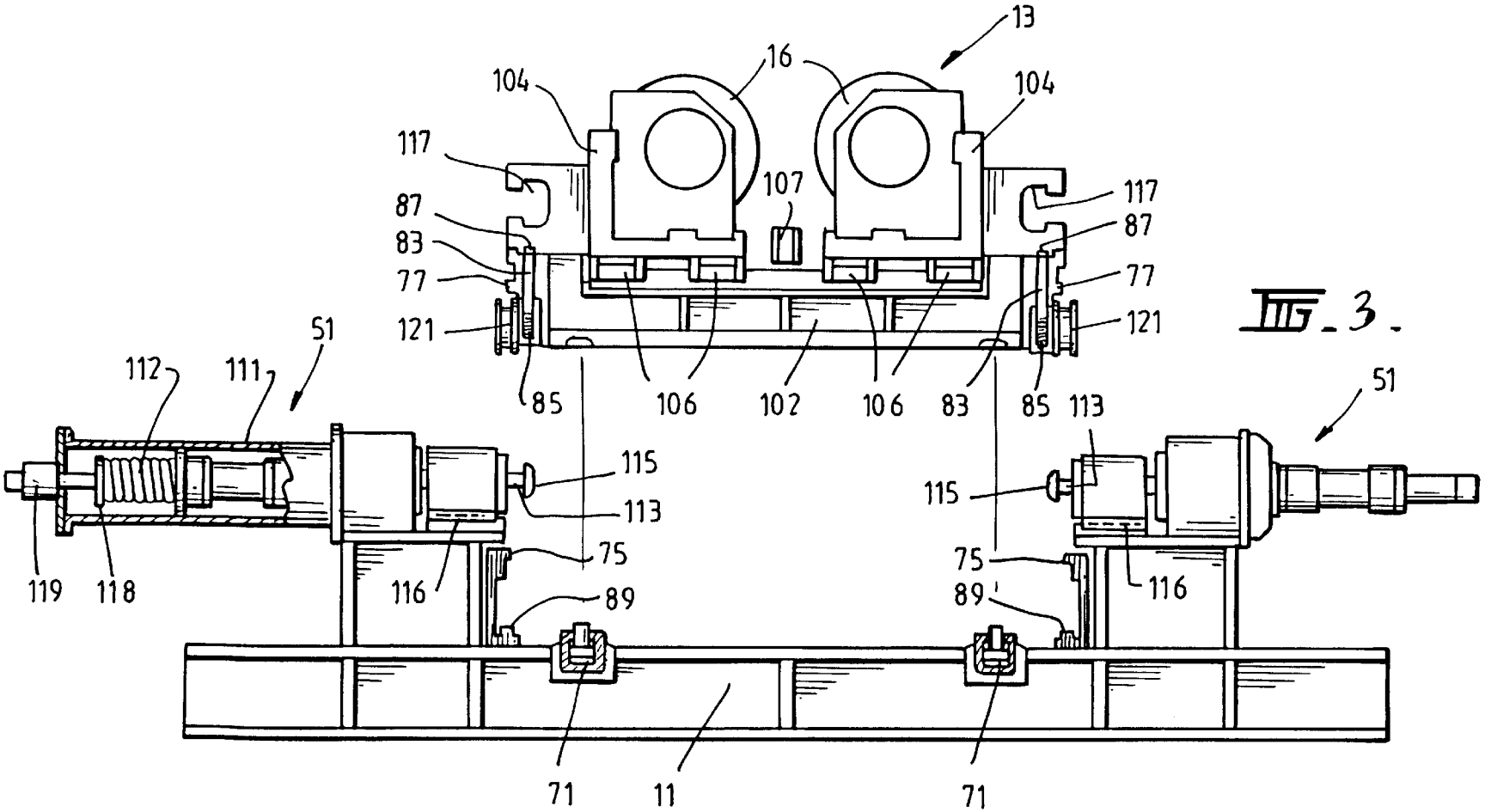
FIG. 3 is the same side elevation as shown in FIG. 2 but with the roll module/casting rolls separated from the caster for clarity.

Roll cassette frame 102 also carries two adjustable spacers 107 (shown only in FIGS. 2 and 3) in the form of a worm or screw driven jack disposed beneath the rolls 16 about a central vertical plane between the rolls 16 and located between the two pairs of roll supports 104 so as to serve as stops limiting inward movement of the two roll supports thereby to define the pre-set nip position, ie the minimum width of the nip between the rolls. The roll biasing units 51 act continuously to bias the roll supports 104 inwardly toward these central stops to permit outward springing movement of the rolls against preset biasing forces.

There are four roll biasing units 51 disposed in two pairs acting one pair on the supports 104 of each roll 16. Each roll biasing unit 51 includes a spring housing 111 containing a biasing spring 112 acting on a thrust rod 113 which is connected at its forward end to the respective roll support 104 The forward end of each thrust rod 113 has an enlarged head 115 located in a keyhole opening 117 in a side of one of the roll supports 104. The heads 115 of the thrust rods 113 are positioned in the keyholes 117 as the roll cassette 13 moves from the stand-by position to the intermediate position. The vertical dimension of the keyholes 117 is larger than the diameter of the enlarged heads 115 to accommodate vertical movement of the roll cassette 13 relative to the roll biasing units 51 as the roll cassette 13 is lifted from the intermediate position to the casting position. Each unit 51 is supported at its forward end on the main machine frame 11 by a linear bearing 116. When the roll cassette 13 is in the casting position shown in FIG. 4 the thruster rods 113 can be translated inwardly by operation of hydraulic cylinder units so that the units 51 can move the rolls 16 to the preset nip position shown in FIG. 5 and then provide a biasing action against the rolls. The spring biasing force of each roll biasing unit 51 can be adjusted by operation of a motor 117 which actuates a screw thread on spring plunger 118 to move the plunger and thereby adjust the compression in the spring 112.

The illustrated caster construction enables the rolls to be accurately set up out of the machine or off-line and rapidly installed when required. Accordingly it is possible to set up rolls between casts in replacement cassettes and to accurately preset the nip spacing. Because the spacing between the rolls is accurately set by the centralised stops and the roll biasing forces bias the rolls inwardly against the stops, it is also possible to preload the rolls with appropriate biasing forces as soon as the cassette is installed and it is not necessary as in previous casters to wait for metal to pass through the rolls to develop reactive forces resisting roll separation. The direct coupling of the roll biasing units between the cassette frame and the roll supports also virtually eliminates friction in the spring control mechanism.

The illustrated caster construction also enables changeover of rolls quickly and effectively without interference with pre-positioned pool confining end plates.

The illustrated caster has been advanced by way of example only and it could be modified considerably. For example it is not essential that the roll supports be mounted on linear bearings for strict linear movement. They could alternatively be supported from the cassette frame on pivot arms to allow arcuate movement providing the necessary lateral movement of the rolls to permit appropriate springing movement. This arrangement would enable further reduction of the effective friction on roll movement. Similarly the roll biasing units 51 could be mounted on pivot arms and brought into position for connection with the installed cassette by actuation of hydraulic or pneumatic cylinder units acting on the supporting pivot arms. The precise manner in which the cassette is transported into and out of the casting machine could also be varied.

Moreover, the spring biasing units could be incorporated into the moveable cassette. However, this would require more moveable components and since each change of cassette would also involve a change of load cells, the cells would need to be recalibrated at each change. It is therefore preferred to mount a single set of biasing units and load cells on the main frame and to connect them to the roll supports when the cassette is moved into its operative position.

It is accordingly to be understood that the invention is in no way limited to the constructional details of the illustrated apparatus and that many modifications and variations may be made without departing from the scope of the appended claims.

What is claimed is:

1. Apparatus for continuously casting metal strip comprising: a pair of parallel casting rolls forming a nip between them; metal delivery means to deliver molten metal into the nip between the rolls to form a casting pool of molten metal supported on casting roll surfaces immediately above the nip; pool confining means at ends of the rolls confining the pool against outflow from the ends of the nip; and roll drive means to drive the casting rolls in counter rotational directions to produce a solidified strip of metal delivered downwardly from the nip; said casting rolls being mounted on a roll module installed in and removable from said apparatus as a unit, said apparatus further comprising means for moving said roll module horizontally in a direction transversely to a casting direction from a stand-by position to an intermediate position beneath a casting position of the rolls and thereafter being movable vertically to lift the rolls to the casting position; and wherein the apparatus includes a lifting means for lifting the roll module and rolls mounted thereon from the intermediate position to the casting position.

2. Apparatus as claimed in claim 1, wherein the lifting means includes a fluid cylinder actuated hoist.

3. Apparatus as claimed in claim 1, wherein the apparatus includes drive coupling means which automatically couple the roll drive means to the casting rolls when the roll module is in the intermediate position.

4. Apparatus as claimed in claim 1, wherein the apparatus includes water coupling means which automatically couple a water cooling means to the rolls when the roll module is in the intermediate position.

5. Apparatus as claimed in claim 1, wherein the roll module further includes a module frame and roll carriers moveable on the module frame to permit bodily movement of the rolls toward and away from one another to vary the nip between them.

6. Apparatus as claimed in claim 5, wherein the roll module further includes an adjustable stop means disposed beneath the nip and between the roll carriers to serve as a spacer stop for engagement with the roll carriers to pre-set the minimum width of the nip between the rolls and adjustable in width to vary the minimum width of the nip.

7. Apparatus as claimed in claim 6, wherein the apparatus further includes roll biasing means operable to move the casting rolls from an open position to the stop means and thereafter to bias the rolls against the stop means.

8. Apparatus as claimed in claim 5, wherein the roll module further includes a means for holding the roll carriers in the open position.

9. Apparatus as claimed in claim 8, wherein the holding means includes a locking pin assembly having locking pins carried by the module frame that can be received in openings in the roll carriers.

10. Apparatus as claimed in claim 9, wherein the locking pins are fixed relative to the roll carriers so that when the roll carriers and the rolls thereon are lifted from the intermediate position to the casting position the roll carriers are moved clear of and therefore are not retained by the locking pins.

11. Apparatus as claimed in claim 5, wherein the roll carriers comprise a pair of roll end support structures for each of the rolls disposed generally beneath the ends of the respective roll.

12. Apparatus as claimed in claim 11, wherein each pair of roll end support structures carries journal bearings mounting the respective roll ends for rotation about a central roll axis.

13. Apparatus as claimed in claim 12, wherein the roll end support structures are mounted on the module frame for generally horizontal movement of the rolls toward and away from one another.

14. Apparatus as claimed in claim 5, wherein the module frame is moveable horizontally on linear bearings into and out of the intermediate position in the caster.

15. Apparatus as claimed in claim 1, wherein the roll module is firmly clamped vertically by operation of the lifting means lifting the roll module so that stop surfaces on the roll module contact fixed stop surfaces on the caster.

16. Apparatus as claimed in claim 15, wherein indexing means is provided for indexing of the module frame with the main machine frame when the module frame is hoisted so as to provide for accurate positioning of the module frame longitudinally of the rolls.

17. Apparatus as claimed in claim 1, wherein the apparatus further includes a roll biasing means operable when the roll module is in the casting position for moving the casting rolls from an open position towards each other to set the width of the nip at a desired width.

18. Apparatus as claimed in claim 1, wherein the pool confining means is in the casting position prior to moving the roll module from stand-by position to the intermediate position and thereafter to the casting position.

19. A method of positioning casting rolls in a continuous strip caster including the steps of: moving a roll module carrying a pair of parallel casting rolls horizontally in a direction transverse to a casting direction from a standby position which is spaced below and to a side of a casting position to an intermediate position below said casting position; coupling said casting rolls to a roll drive means and to a water cooling unit at said intermediate position; and lifting the roll module to said casting position.

20. A method as claimed in claim 19, wherein the roll drive means and the water cooling unit are automatically coupled to the rolls when the roll module is moved to the intermediate position.

21. A method as claimed in claim 19, wherein after lifting the roll module to the casting position, the method further includes moving the rolls inwardly to a pre-set nip position.

22. A method as claimed in claim 21, wherein the rolls are held apart prior to being lifted to the casting position and the lifting movement releases the rolls for inward movement.

23. A method as claimed in claim 1, wherein a pair of casting pool confinement plates are positioned one to either side of the space to be occupied by the casting rolls when in the casting position and the casting rolls move upwardly between the pool confinement plates when the roll module is lifted to the casting position.

* * * * *

UNITED STATES PATENT AND TRADEMARK OFFICE

CERTIFICATE OF CORRECTION

PATENT NO. : 6,164,366
DATED : December 26, 2000
INVENTOR(S) : John Andrew Fish et al.

It is certified that error appears in the above-identified patent and that said Letters Patent is hereby corrected as shown below:

Column 10,
Line 7, (claim 23, line 1), "claim 1" is changed to -- claim 19 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*